United States Patent [19]

Thorogood

[11] 4,131,155

[45] Dec. 26, 1978

[54] REVERSIBLE HEAT EXCHANGER OR REGENERATOR SYSTEMS

[75] Inventor: Robert M. Thorogood, London, England

[73] Assignee: Air Products and Chemicals, Inc., Allentown, Pa.

[21] Appl. No.: 843,816

[22] Filed: Oct. 20, 1977

Related U.S. Application Data

[62] Division of Ser. No. 652,681, Jan. 27, 1976, Pat. No. 4,063,588.

[30] Foreign Application Priority Data

Jan. 28, 1975 [GB] United Kingdom ..... 3738/75

[51] Int. Cl.[2] ..... F28G 15/04; F28G 9/00

[52] U.S. Cl. ..... 165/1; 62/13; 165/95; 165/97

[58] Field of Search ..... 165/1, 95, 97; 62/13, 62/14, 15; 137/240

[56] References Cited

U.S. PATENT DOCUMENTS

| | | | |
|---|---|---|---|
| 2,107,335 | 2/1938 | Linde et al. | 62/13 |
| 2,537,276 | 1/1951 | McMahon et al. | 165/97 |
| 3,466,884 | 9/1969 | Ruckborn | 62/13 |
| 3,770,050 | 11/1973 | Nakanishi | 165/97 |

*Primary Examiner*—Charles J. Myhre
*Assistant Examiner*—Sheldon Richter
*Attorney, Agent, or Firm*—James C. Simmons; Barry Moyerman

[57] ABSTRACT

A heat exchanger or regenerator system useable in an air separation plant to minimize infiltration of air into the low pressure nitrogen stream comprising a heat exchanger (regenerator) having at least one flow path for the reversing heat exchange fluids, which flow path has at each end, an inlet branch and an outlet branch, wherein each branch has two series connected valves with a vent pipe between each pair of valves. Fluid flow through the vent pipe is controlled, e.g. by remotely actuable switch valves.

3 Claims, 2 Drawing Figures

REVERSIBLE HEAT EXCHANGER OR REGENERATOR SYSTEMS

This is a division of application Ser. No. 652,681 filed Jan. 27, 1976 now U.S. Pat. No. 4,063,588 issued Dec. 20, 1977.

BACKGROUND OF THE INVENTION

This invention pertains to reversible heat exchanger or regenerator systems used in an air separation plant for the production of, inter alia, pure nitrogen by the fractional distillation of liquefied air.

In the conventional air separation plant using a low pressure distillation cycle it is customary to remove water and carbon dioxide from the incoming air by condensing these constituents on the surfaces of a heat exchanger or regenerator. The heat exchanger (regenerator) is constructed so that the impurities condensed onto the surfaces of the exchanger can be removed by stopping the flow of the incoming air (gas) and forcing a low pressure gas through the exchanger in the reverse direction to evaporate the impurities and remove them from the plant and thus prepare the exchanger to treat incoming air. In ordinary air plants the low pressure gas is a waste product stream which is alternately cycled between several exchangers to provide continuous purging or cleaning of the surfaces of the exchanger not being used to treat the incoming air. In most instances the low pressure gas contains small quantities of air that leaks into the stream through a switch or check valve because of the pressure differential between the two streams.

SUMMARY OF THE INVENTION

In order to overcome the problem of air infiltration into the low pressure gas, a reversible heat exchanger or regenerator system has been invented which comprises a heat exchanger or regenerator having at least one flow path for the reversing heat exchange fluids, which flow path has at each end, an inlet branch and an outlet branch, wherein each branch is provided with two valves arranged in series, a vent pipe in communication with the branch between the two valves and means for controlling the flow of fluid through said vent pipe.

The means may comprise, for example remotely actuable switch valves or orifices.

In use, the inlet branches are connected to sources of different fluids with the inlet branch at the warm end connected to a supply of air while the inlet branch at the cold end is connected to a high purity, low pressure, nitrogen stream. By venting any leakage air before it can reach the low pressure nitrogen stream, contamination of the low pressure nitrogen stream with leakage air is minimized.

Therefore, it is the primary object of the present invention to provide an improved reversing heat exchanger or regenerator.

It is another object of this invention to provide a reversing heat exchanger (regenerator) system to minimize contamination of the low pressure purge gas.

It is still another object of the present invention to provide a reversing heat exchanger system for an air separation plant.

DESCRIPTION OF THE PREFERRED EMBODIMENT

Figure 1:
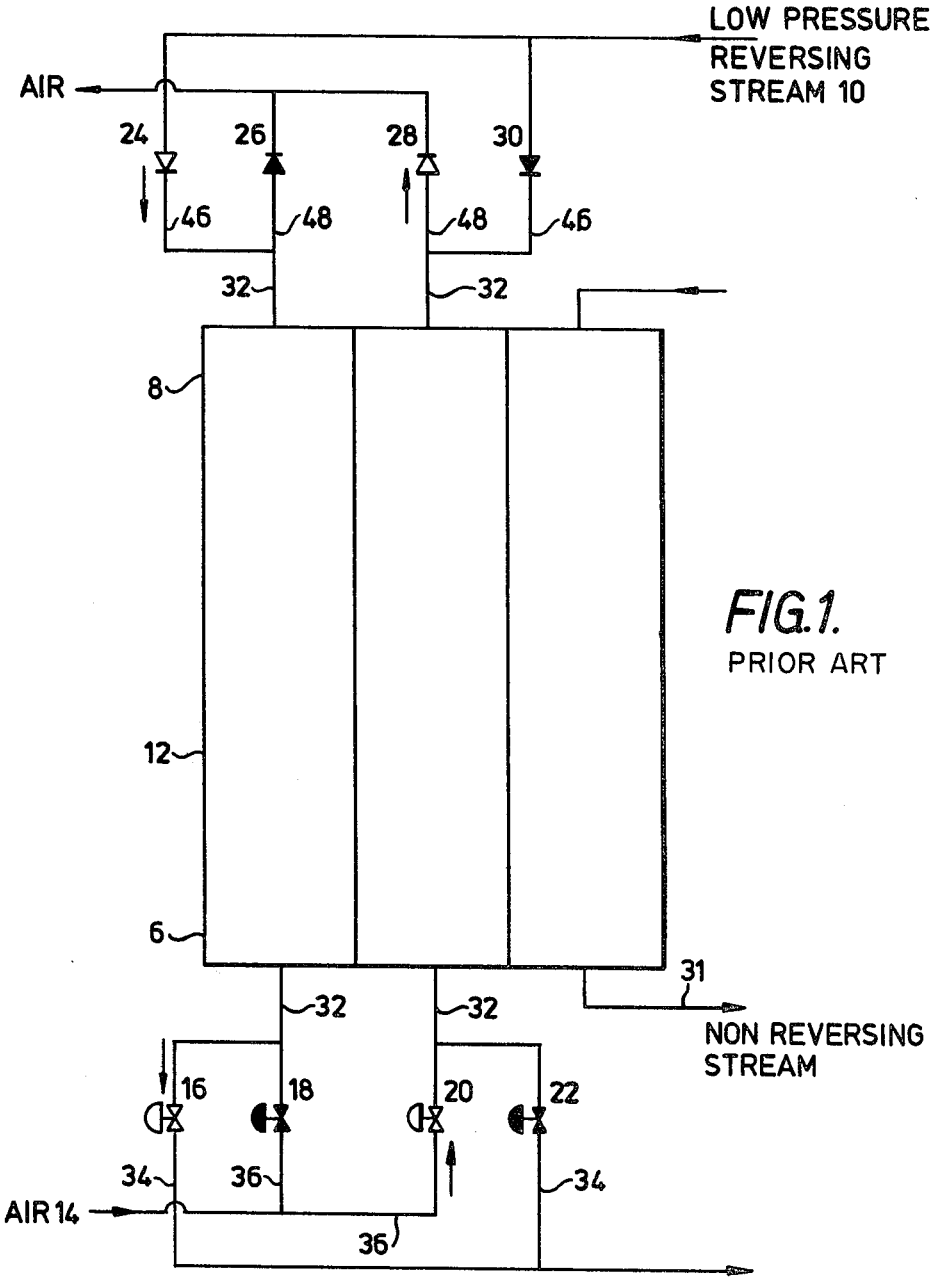
FIG. 1. PRIOR ART
FIG. 1 is a schematic drawing of the heat exchanger section of a typical air plant.

In a typical air separation plant using the low pressure distillation cycle it is standard practice to remove water and carbon dioxide from the incoming air by condensation on the surfaces of a reversing heat exchanger or regenerator system such as shown in FIG. 1 of the accompanying drawing. Deposited impurities are subsequently removed by flowing gas 10 at lower pressure in the reverse direction through the heat exchanger or regenerator 12, thereby evaporating the impurities and discharging them from the plant. The heat exchanger 12 has a flow path 31 for a non-reversing stream and two parallel flow paths 32 the ends of each of which divide into two branches. At the warm end 6 of the heat exchanger 12, the flow paths 32 each divide into a low pressure gas outlet branch 34 and an air inlet branch 36 and, at the cold end 8 of the heat exchanger 12, each flow path 32 divides into a low pressure gas inlet branch 46 and an air outlet branch 48.

Interchange of the air flow 14 and low pressure gas flow 10 in the heat exchanger 12 is effected by a system of switch valves 16, 18, 20 and 22 at the warm end of the exchanger, and check valves 24, 26, 28 and 30 at the cold end of the exchanger. Generally the low pressure gas 10 is a waste product from the plant, and thus minor leakage of air (typically at 90 psia) across a closed switch or check valve into the low pressure gas (typically at 18 psia) is not of importance since the resulting contamination of the low pressure gas is of no consequence. However, in some instances it is important that the low pressure gas 10 should not be contaminated with air 14 although contamination with water and/or carbon dioxide is acceptable. In particular, a gas comprising mainly nitrogen with carbon dioxide and water can be used for the de-oxygenation of seawater.

In this application it is important tht the nitrogen contains carbon dioxide but has a low oxygen content. The retention of carbon dioxide in the nitrogen, and thus also in the seawater, inhibits calcium carbonate deposition (scaling) by inhibiting a shift from bicarbonate in the equilibrium:

$$Ca(HCO_3)_2 \rightleftarrows CaCO_3 + CO_2 + H_2O$$

According to this invention, a reversible heat exchanger or regenerator system comprises a heat exchanger or regenerator having at least one flow path for the reversing heat exchange fluids, which flow path has at each end, an inlet branch and an outlet branch, wherein each branch is provided with two valves arranged in series, a vent pipe in communication with the branch between the two valves and means for controlling the flow of fluid through said vent pipe.

The means may comprise, for example remotely actuable switch valves or orifices.

In use, the inlet branches are connected to sources of different fluids and, in the preferred embodiment described hereinafter the inlet branch at the warm end is connected to a supply of air while the inlet branch at the cold end is connected to a high purity, low pressure, nitrogen stream. By venting any leakage air before it can reach the low pressure nitrogen stream, contamination of the low pressure nitrogen stream with leakage air is minimized.

At the warm end of the heat exchanger the valves arranged in series preferably comprise a remotely actuable switch valve and a check valve downstream thereof. At the cold end of the heat exchanger both of the valves arranged in series in the branches are preferably check valves.

In the preferred embodiment the valves at the cold end of the heat exchanger are check valves and each vent pipe includes an adjustable orifice fitted downstream or upstream of a remotely actuable valve. Because the valves in the branches at the cold end are check valves, there will be a continuous flow of the low pressure gas to vent along with any leakage gas from the closed valve. The adjustable orifices allow control of this flow to suit the leakage rate of the closed valve. The leakage of low pressure gas may also be reduced by biasing appropriate check valves closed, for example as hereinafter described.

There is also provided a method of operating a system according to the present invention which method comprises the steps of passing a first gas (e.g. air) through said heat exchanger or regenerator via the inlet branch at one end of said heat exchanger or regenerator and the outlet branch at the other end thereof whilst venting leakage gas through the vent pipes associated with the outlet branch at said one end of said heat exchanger or regenerator and the inlet branch at the other end thereof; and subsequently passing a second gas (e.g. pure or substantially pure nitrogen), at a lower pressure than said first gas, through said heat exchanger via the inlet branch at the other end of said heat exchanger and the outlet branch at said one end of said heat exchanger whilst venting leakage gas through the vent pipes associated with the inlet branch at said one end of said heat exchanger or regenerator and the outlet branch at the other end thereof.

Figure 2:
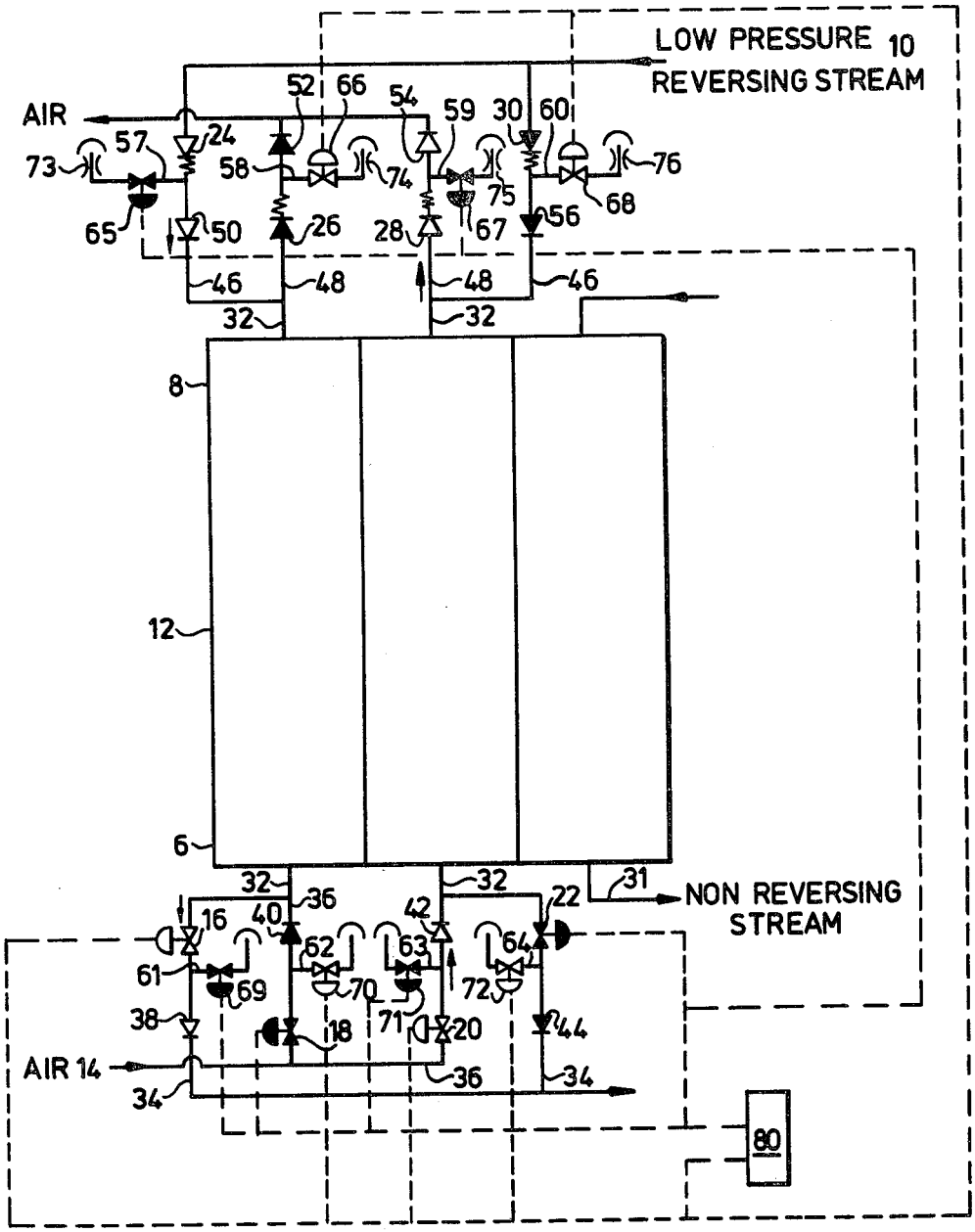
FIG. 2 is a schematic drawing of the reversible heat exchanger system according to the present invention as it would be used in a conventional air separation plant.

For a better understanding of the invention reference will now be made by way of example to FIG. 2 of the accompanying drawings which shows a reversible heat exchanger system in accordance with the present invention forming part of an air separation plant.

The conventional reversible heat exchanger system of FIG. 1 can be converted into a system according to the present invention by placing a check valve in series with and downstream of each of the switch valves 16, 18, 20 and 22, and check valves 24, 26, 28 and 30 normally used. In particular, check valves 50, 52, 54 and 56 are arranged downstream of check valves 24, 26, 28 and 30 respectively. At the warm end 6 of the reversible heat exchanger 12, the check valves 38, 40, 42 and 44 are arranged downstream of switch valves 16, 18, 20 and 22 respectively. Vent pipes 57 to 64 are arranged between valves 24 and 50; 26 and 52; 28 and 54; 30 and 56; 16 and 38; 18 and 40; 20 and 42; and 22 and 44 respectively. The vent pipes 57 to 60 vent to atmosphere. Alternatively they may be connected to a waste pipe (not shown) entering the cold end 8 of the heat exchanger 12. The vent pipes 61 to 64 from the warm end 6 of the heat exchanger 12 vent directly to atmosphere or to a suitable warm waste pipe. The vent pipes 57 and 64 are each provided with a secondary remotely operable valve 65 to 72 and vent pipes 57 to 60 are each provided with a variable orifice 73 to 76 respectively.

In use, each secondary valve 69 to 72 is opened when the valves in its associated branch are closed. Thus, secondary valves 70 and 72 are opened when valves 18, 40; and 22, 44 are closed. Similarly, secondary valves 69 and 71 are opened when valves 16 and 38; and valves 20 and 42 are closed.

At the cold end 8 of the heat exchanger 12, secondary valves 66 and 68 are opened and closed with valves 16, 70, 20 and 72. Secondary valves 65 and 67 are opened and closed with valves 69, 18, 71 and 22.

The valves 16, 18, 20, 22, 65, 66, 67, 68, 69, 70, 71 and 72 are all controlled by a valve timer 80.

At the cold end 8 of the heat exchanger 12 there will be a continuous flow of the low pressure nitrogen to vent along with any leakage air from the closed valve. The flow of vent gas may be controlled by the adjustable orifices 73 to 76 to suit the leakage rate of the closed valves. The check valves 24, 26, 28 and 30 are provided with light springs so that they will remain closed against a small pressure differential between the low pressure nitrogen and the vents. In this connection it should be appreciated that with the valve in, for example vent pipe 58, open and the orifice 74 correctly adjusted the pressure in the vent pipe 58 will normally be only slightly less than the pressure of the low pressure nitrogen. Thus, a restricted flow path is provided which inhibits back diffusion of air into the low pressure nitrogen.

It should be noted that the preferred embodiment is primarily concerned with preventing air penetrating the low pressure nitrogen stream during steady state operation of the heat exchanger. At the end of a cycle during which air has been passed through one flow path of the heat exchanger that flow path will contain a substantial quantity of air. When low pressure gas is admitted to this flow path at the commencement of the next cycle this air must be vented. In the preferred embodiment such venting is carried out through a vent (not shown) downstream of valves 38 and 44. Alternatively the venting may be effected through vent pipe 61 or vent pipe 64.

For the avoidance of doubt, valves 65 to 72 could conceivably be replaced by orifices with the consequent omission of adjustable orifices 73 to 76. Such an arrangement, whilst within the scope of the present invention, is not however recommended since the additional gas losses far outweigh any initial saving in capital expenditure.

Having thus described my intention what is desired to be reserved for me and my assigns by Letters Patent of the United States is set forth in the appended claims.

I claim:

1. A method of operating a reversible heat exchanger or regenerator system which method comprises the steps of passing a first gas through said heat exchanger or regenerator via an inlet branch at a first or warm end of said heat exchanger or regenerator and an outlet branch at a second or cold end thereof whilst venting leakage gas through a first vent pipe associated with an outlet branch at the warm end of said heat exchanger or regenerator and a second vent pipe associated with an inlet branch at the cold end thereof; and subsequently passing a second gas at a lower pressure than said first gas, through said heat exchanger via the inlet branch at the cold end of said heat exchanger and the outlet branch at said warm end of said heat exchanger whilst venting leakage gas through a third vent pipe associated with the inlet branch at said warm end of said heat exchanger or regenerator and a fourth vent pipe associated with the outlet branch at the cold end thereof.

2. A method according to claim 1, wherein said first gas is air.

3. A method according to claim 2 wherein said second gas is substantially pure nitrogen.

* * * * *